US006679691B1

(12) United States Patent
Barto et al.

(10) Patent No.: US 6,679,691 B1
(45) Date of Patent: Jan. 20, 2004

(54) ANTI CAVITATION SYSTEM FOR TWO-SPEED MOTORS

(75) Inventors: Michael W. Barto, Shakopee, MN (US); Mark D. Schuster, Wahpeton, ND (US); John B. Heckel, Shakopee, MN (US); Marvin L. Bernstrom, Eden Prairie, MN (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/282,633

(22) Filed: Oct. 29, 2002

(51) Int. Cl.[7] ..... F01C 1/10; F03C 2/08
(52) U.S. Cl. ..... 418/61.3; 418/1
(58) Field of Search ..... 418/1, 61.3; 60/424

(56) References Cited

U.S. PATENT DOCUMENTS 3,788,075 A * 1/1974 Holdeman et al. ..... 60/424
4,480,971 A 11/1984 Swedberg ..... 418/61.3
6,068,460 A * 5/2000 Haarstad et al. ..... 418/61.3
6,099,280 A 8/2000 Bernstrom et al. ..... 418/61.3

* cited by examiner

*Primary Examiner*—John J. Vrablik
(74) *Attorney, Agent, or Firm*—L. J. Kasper

(57) ABSTRACT

A two-speed gerotor motor (10) including motor valve means (19,43) to communicate fluid to and from expanding (33E) and contracting (33*c*) fluid volume chambers. The motor includes a shift valve spool (61) to cause the motor to operate either in the normal, low-speed, high-torque (LSHT) mode (FIG. 3) or in a high-speed, low-torque (HSLT) mode (FIG. 4). When the motor operates in HSLT mode, certain of the volume chambers comprise recirculating volume chambers (33R). The motor (10) defines a supplemental fluid passage (89) through which fluid is communicated from a system charge pump (73) to each of the recirculating volume chambers (33R). A control valve (83) is operable, in a shift mode (S) to permit fluid communication from the charge pump (73) to the supplemental fluid passage (89), thus preventing cavitation during shifting of the motor (10), especially when shifting from the HSLT mode to the LSHT mode.

9 Claims, 5 Drawing Sheets

LSHT

HSLT

ANTI CAVITATION SYSTEM FOR TWO-SPEED MOTORS

BACKGROUND OF THE DISCLOSURE

The present invention relates to rotary fluid pressure devices of the type in which a gerotor gear set typically serves as the fluid displacement mechanism, and more particularly, to such devices which are provided with multiple-speed (multiple-displacement) capability. Furthermore, the present invention relates to an improved method for controlling the shifting (between different speeds) of such a multiple-speed device.

Although the teachings of the present invention can be applied advantageously to devices having fluid displacement mechanisms other than gerotor gear sets (such as radial piston and cam lobe type devices), the present invention is especially adapted for use with devices utilizing gerotor gear sets, and will be described in connection therewith. Furthermore, the present invention is especially adapted for devices to be utilized as motors, and will be described in connection therewith.

Motors utilizing gerotor gear sets can be used in a variety of applications, one of the more common applications being vehicle propulsion, wherein the vehicle includes an engine driven pump which provides pressurized fluid to a vehicle hydraulic propel circuit, including a pair of gerotor motors, with each motor being associated with one of the drive wheels. Those skilled in the art will understand that many gerotor motors utilize a roller gerotor gear set, especially on larger, higher torque motors of the type typically used in propel applications, and subsequent references hereinafter to a "gerotor" will be understood to mean and include both a conventional gerotor as well as a roller gerotor, and for purposes of this invention, "gerotor" can include either an IGR (internally-generated rotor) or and EGR (externally-generated rotor), both of which are now generally well known to those skilled in the art.

Multiple-speed gerotor motors are known from U.S. Pat. Nos. 4,480,971; 6,068,460; and 6,099,280, all of which are assigned to the assignee of the present invention and incorporated herein by reference. The device of the '971 patent has been in widespread commercial use and has performed in a generally satisfactory manner, and more recently, the devices of the '460 and '280 patents have also come into commercial usage. As is now well know to those skilled in the art, a gerotor motor may be operated as a multiple-speed (multiple displacement) device by providing valving which can effectively "recirculate" fluid between expanding and contracting fluid volume chambers of the gerotor gear set. If the inlet port communicates with all of the expanding volume chambers, and all of the contracting volume chambers communicate with the outlet port, the motor operates in the normal, low-speed, high-torque (LSHT) mode. If some of the fluid from certain of the contracting volume chambers (the "recirculating" chambers) is recirculated back to the expanding volume chambers, the result will be operation in a high-speed, low-torque (HSLT) mode. The HSLT mode yields the same result as if the displacement of the gerotor were decreased, but with the same fluid flow rate through the gerotor.

The multiple-speed gerotor motors, made in accordance with the above-incorporated patents, and sold commercially by the assignee of the present invention, operate very satisfactorily in both the LSHT and the HSLT modes. It has been observed, however, that when the motor is shifted from one mode to the other (and especially, from the HSLT mode to the LSHT mode), there is a tendency for cavitation to occur in the gerotor gear set just as the shift is occurring from one mode to the other. During the shift from HSLT to LSHT, the "displacement" of the motor increases, while the speed of the vehicle and the pump flow remain, at least in the short term, generally constant. Thus, the gerotor gear set is suddenly being "displaced" at a speed corresponding to an instantaneous fluid flow rate which is greater than what the pump can immediately provide.

The recirculating fluid volume chambers have the greatest tendency to cavitate because of greater restriction in the recirculation flow path than in the flow paths to and from those volume chambers which don't recirculate. As is well know to those skilled in the art, cavitation occurring within a fluid displacement element, such as a gerotor, causes a substantial amount of undesirable noise, and can also eventually result in damage to the displacement mechanism. Typically, the cavitation will continue until the vehicle slows down to a speed at which the pump flow "catches up with" the speed (displacement) of the gerotor gear set in the motor.

BRIEF SUMMARY OF THE INVENTION

Accordingly, it is an object of the present invention to provide an improved fluid pressure operated device having multiple-speed capability, in which shifting from one mode to another does not result in any substantial amount of cavitation and noise.

It is a more specific object of the present invention to provide an improved method for controlling the shifting of a multiple-speed fluid pressure operated device, wherein the shifting occurs without any substantial amount of cavitation and noise.

The above and other objects of the invention are accomplished by the provision of an improved fluid pressure operated device comprising housing means defining a fluid inlet port and a fluid outlet port. A fluid pressure displacement mechanism is associated with the housing means and includes an internally toothed ring member and an externally toothed star member eccentrically disposed within the ring member, the ring member and the star member having relative orbital and rotational movement, and interengaging to define a plurality N of expanding and contracting fluid volume chambers in response to the orbital and rotational movement. A motor valve means cooperates with the housing means to provide fluid communication between the fluid inlet port and the expanding volume chambers, and between the contracting volume chambers and the fluid outlet port in a normal, low-speed, high-torque mode of operation. A shift valve means is operable, in a first condition, to permit the normal low-speed, high-torque mode of operation and, in a second condition, to interconnect a plurality M of the volume chambers, the plurality M comprising recirculating volume chambers.

The improved fluid pressure operated device is characterized by the device defining a supplemental fluid passage operable to provide fluid communication from a source of pressurized fluid to each of the plurality M of recirculating volume chambers. A control valve means is operable, in a normal mode, to block fluid communication from the source of pressurized fluid to the supplemental fluid passage and in a shift mode, to permit fluid communication from the source of pressurized fluid to the supplemental fluid passage.

In accordance with another aspect of the present invention, there is provided an improved method of controlling the shifting of a multiple-speed fluid pressure operated device from a first speed ratio to a second speed ratio, the device comprising housing means and a fluid pressure displacement mechanism as described previously. A motor valve means cooperates with the housing means to provide fluid communication in the normal manner in the first speed ratio. A shift valve means is operable in a first condition to achieve the first speed ratio, and in a second condition, to achieve the second speed ratio by interconnecting a plurality M of the volume chambers as recirculating volume chambers.

The improved method of controlling the shifting comprises the steps of providing a source of pressurized fluid and a supplemental fluid passage, operable to provide fluid communication from the source to each of the plurality M of recirculating volume chambers. The next step is changing the shift valve means from the first condition to the second condition, and then sensing the changing of the shift valve means and only while the changing is being sensed, generating a change sense signal. The final step is detecting the change sense signal, and in response thereto, permitting fluid communication from the source of pressurized fluid, through the supplemental fluid passage, to the plurality M of recirculating volume chambers.

DETAILED DESCRIPTION OF THE PREFERRED EMBODIMENT

Figure 1:
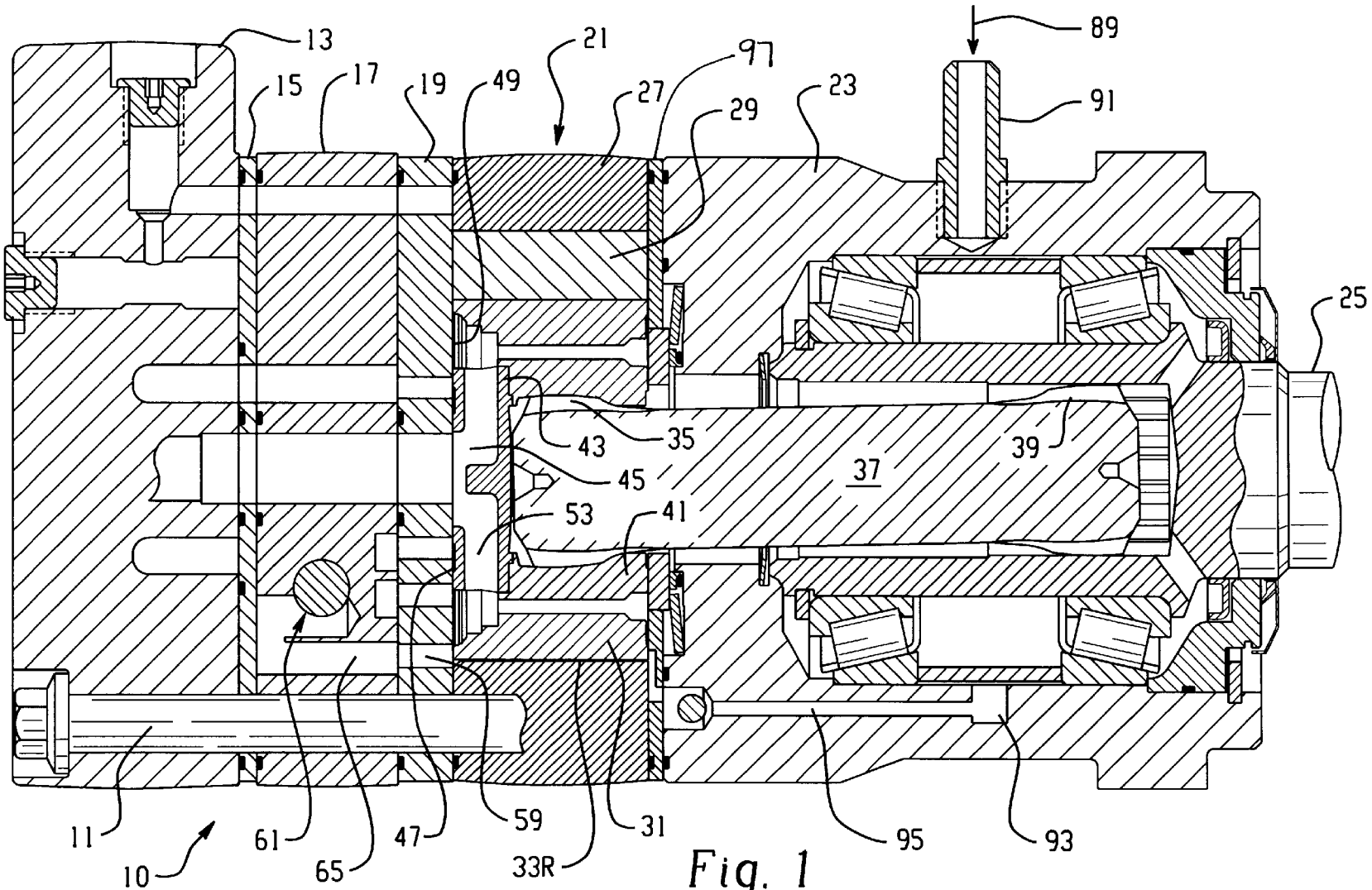
FIG. 1 is an axial cross-section of a low-speed, high-torque gerotor motor made in accordance with the teachings of the present invention.

Referring now to the drawings, which are not intended to limit the invention, FIG. 1 illustrates a valve-in-star (VIS) type of low-speed, high-torque (LSHT) gerotor motor, generally designated 10, made generally in accordance with the teachings of U.S. Pat. No. 5,211,551, assigned to the assignee of the present invention and incorporated herein by reference. More specifically, the gerotor motor shown in FIG. 1 is a multiple-speed motor made in accordance with the teachings of the above-incorporated U.S. Pat. Nos. 6,068,460 and 6,099,280. However, it should be understood that the present invention is not limited to a VIS type of gerotor motor, and as was mentioned in the BACKGROUND OF THE DISCLOSURE, the invention is not even limited to only gerotor type devices, but is limited only to the extent specifically set forth in the appended claims.

Figure 2:
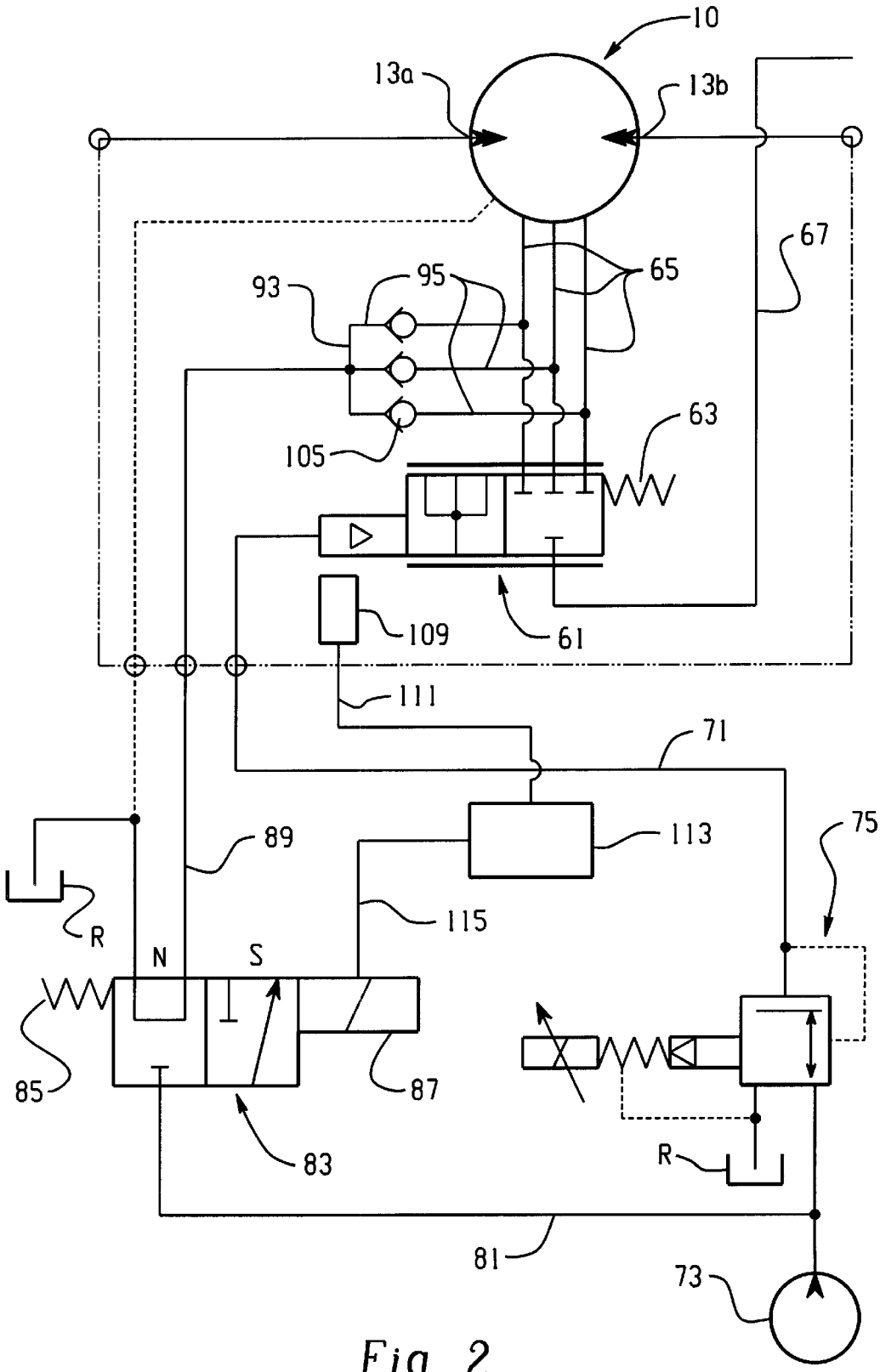
FIG. 2 is a hydraulic schematic of the entire control system for shifting the gerotor motor illustrated in FIG. 1.
Figure 3:
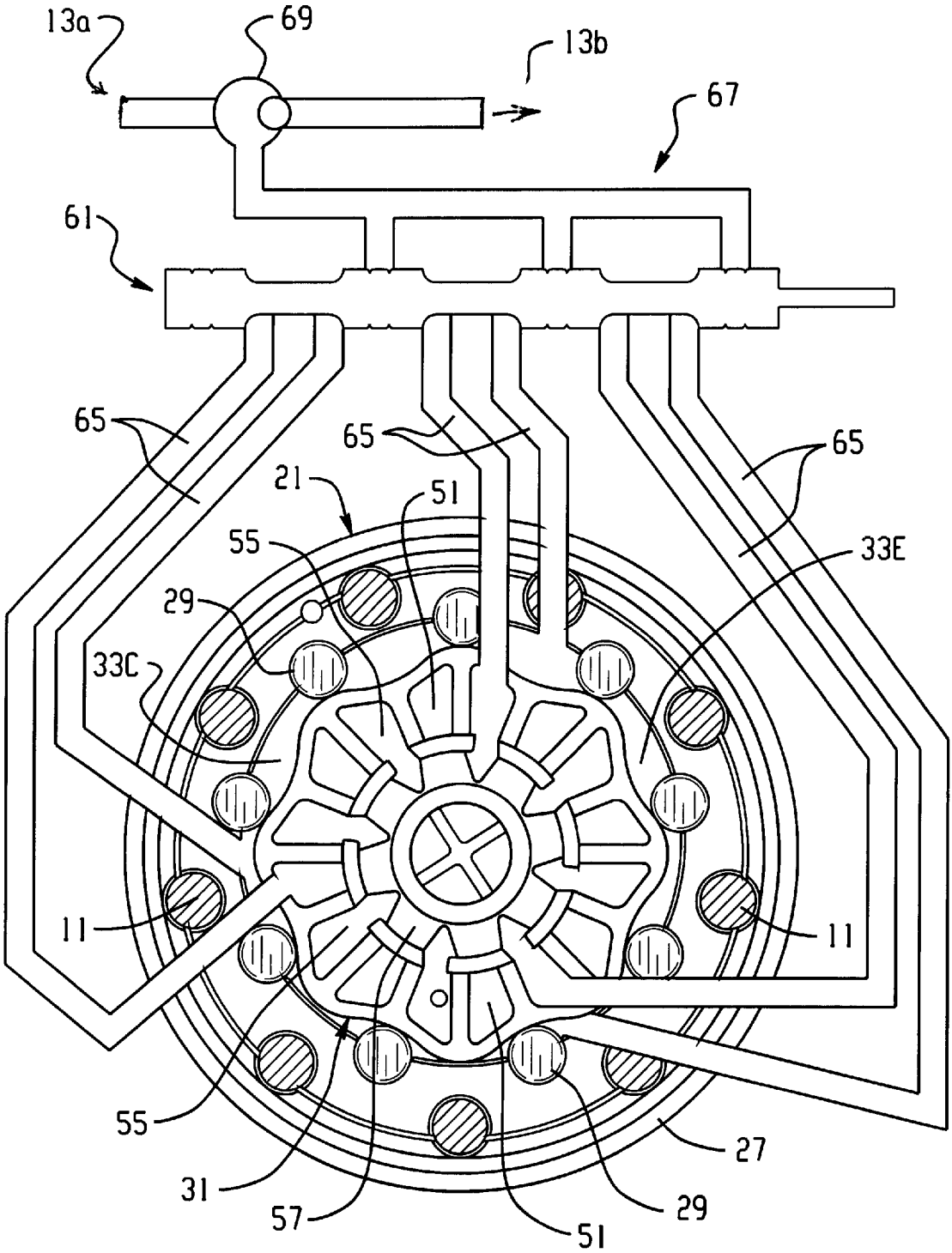
FIG. 3 is a somewhat schematic view, illustrating the gerotor motor of the present invention in the LSHT mode.
Figure 4:
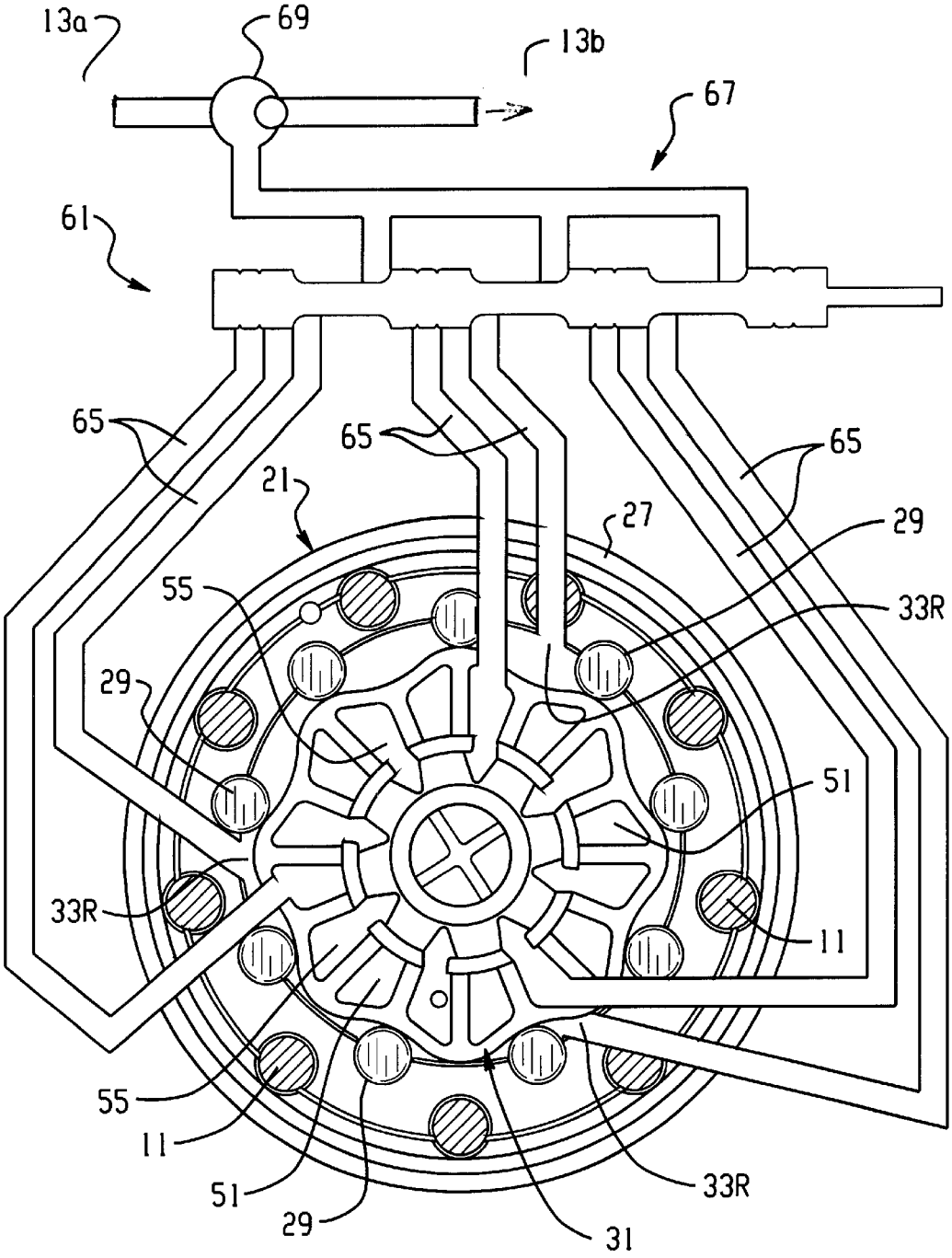
FIG. 4 is a somewhat schematic view, similar to FIG. 3, but illustrating the gerotor motor of the present invention in the HSLT mode.

The VIS motor 10 shown in FIG. 1 comprises a plurality of sections secured together such as by a plurality of bolts 11, only one of which is shown in FIG. 1, but all of which are shown in FIGS. 3 and 4. The motor includes an end cap 13, a spacer plate 15, a shifter plate 17 (which may also be referred to as a "selector plate"), a stationary valve plate 19, a gerotor gear set, generally designated 21, and a forward bearing housing 23, rotatably supporting an output shaft 25. The end cap 13 defines a fluid inlet port 13*a* and a fluid outlet port 13*b* (which are not shown in FIG. 1, for ease of illustration, but which are shown in the schematics of FIGS. 2, 3 and 4). As is well known to those skilled in the motor art, if the port 13*a* becomes the outlet port and the port 13*b*becomes the inlet port, the direction of rotation of the output shaft 25 is reversed.

The gerotor gear set 21, also seen in FIGS. 3 and 4, is well known in the art, is shown and described in greater detail in the above-incorporated patents, and therefore will be described only briefly herein. The gerotor gear set 21 comprises an internally toothed ring member 27, defining a plurality of generally semi-cylindrical openings, with a cylindrical roller member 29 disposed in each of the openings, and serving as the internal teeth of the ring member 27. Eccentrically disposed within the ring member 27 is an externally toothed star member 31, typically having one less external tooth than the number of internal teeth or rollers 29, thus permitting the star member 31 to orbit and rotate relative to the ring member 27. The orbital and rotational movement of the star 31 within the ring 27 defines a plurality of fluid volume chambers 33, each of which, at any given instant in time, is either an expanding volume chamber 33E, or a contacting volume chamber 33C. As is well know to those skilled in the gerotor art, there is also, at any given instant in time, one of the volume chambers which is in a state of "transition" between expanding and contracting. In the subject embodiment, and by way of example only, there is a total of nine volume chambers 33.

Referring still primarily to FIG. 1, the star 31 defines a plurality of straight, internal splines which are in engagement with a set of external, crowned splines 35, formed about one end of a main drive shaft 37. Disposed at the opposite end of the shaft 37 is another set of external, crowned splines 39, adapted to be in engagement with a plurality of straight, internal splines, defined by the output shaft 25.

Referring still primarily to FIG. 1, but now in conjunction with FIGS. 3 and 4, the star member 31 will be described in some additional detail. In the subject embodiment, and by way of example only, the star 31 comprises an assembly of two separate parts including a main star portion 41, which includes the external teeth of the star, and an insert or plug 43. The main portion 41 and the insert 43 cooperate to define the various fluid zones, passages and ports which are described in detail in the above-incorporated patents, and therefore, will not be described in detail hereinafter. The star member 31 defines a central manifold zone 45, defined by an end surface 47 disposed in sliding, sealing engagement with an adjacent surface 49 of the stationary valve plate 19.

The end surface 47 of the star 31 defines a set of fluid ports 51, each of which is in continuous fluid communication with the manifold zone 45 by means of a fluid passage 53 defined by the insert 43. The end surface 47 further defines a set of fluid ports 55 which are arranged alternately with the fluid ports 51, each of the fluid ports 55 extending radially inward and opening into an outer manifold zone 57 (shown only in FIGS. 3 and 4), surrounding the central manifold zone 45. The stationary valve plate 19 defines a plurality of stationary valve passages 59, only one of which is shown in FIG. 1. As the star member 31 orbits and rotates, each of the fluid ports 51 and 55 defined by the insert 43 engages in commutating fluid communication with each of the stationary valve passages 59, thus porting, alternately, high pressure fluid to each volume chamber 33 while it is an expanding volume chamber 33E, and then receiving low pressure fluid from each volume chamber 33, while it is a contracting volume chamber 33C. The valving arrangement just described is well known to those skilled in the gerotor motor art, is illustrated and described in greater detail in the incorporated patents, and is referenced hereinafter in the appended claims as the "motor valve means", i.e., the valving which achieves the basic operation of the motor.

Referring now primarily to FIGS. 3 and 4, but also somewhat to FIGS. 1 and 2, the means by which the motor 10 of the present invention achieves multiple speed operation will be described. The motor 10 includes a shift valve spool 61 which, as is shown schematically in FIG. 2, is biased by a compression spring 63 toward a first condition, as shown in FIG. 3, in which the motor 10 is in its normal low-speed, high-torque ("LSHT") mode of operation. As is shown schematically in FIG. 2, and as may be seen in FIG. 1, each volume chamber of the motor which is to recirculate (and therefore is referred to also as a "recirculating volume chamber 33R") is connected, through its respective stationary valve passage 59, by means of a fluid passage 65, to the shift valve spool 61. It should be noted that in FIGS. 3 and 4, each "passage" 65 actually appears, schematically, as two separate passages, one between the shift valve spool 61 and the star port (51 or 55), and the other between the shift valve spool 61 and the recirculating volume chamber 33R. However, for the purposes of the subsequent description and the appended claims, each such "pair" will be referenced as the passage 65.

In the LSHT mode of FIG. 3, the shift valve spool 61 is in a position which isolates each of the passages 65 from the other passages 65, and also isolates each fluid passage 65 from a "source" of recirculation fluid, the source being designated 67. As is now well know to those skilled in the art, the source 67 may simply be the inlet port 13*a* (see FIG. 3), and in the case of a bi-directional motor, the source 67 could also be connected to the other port 13*b* (when the port 13*b* is serving as the inlet port). Therefore, some sort of shuttle valve arrangement, generally designated 69, is positioned such that whichever of the ports 13*a* or 13*b* is at the higher pressure will be in fluid communication with the fluid passage comprising the source 67. The structural and operational details associated with the source 67 and the shift valve spool 61 are now well know to those skilled in the art, are not essential to the present invention, and therefore will not be described further herein.

Referring now primarily to FIGS. 2 and 4, the shift valve spool 61 may be shifted, in opposition to the force of the compression spring 63, by a pressure signal 71 which is communicated from a source of pressurized fluid, such as a system charge pump 73. The flow of fluid from the charge pump 73 to the shift valve spool 61 is controlled by a pressure reducing valve 75, the construction and operational details of which are not essential to the present invention, and are beyond the scope of the present invention, and therefore, will not be described further herein. Suffice it to say that the pressure reducing valve 75 is able to control the pressure communicated as the pressure signal 71 to control the shifting of the shift valve spool 61 from the position shown schematically in FIG. 2 (and in FIG. 3) to the position shown in FIG. 4. The position of the shift valve spool 61 in FIG. 4 comprises a second condition, corresponding to a high-speed, low-torque ("HSLT") mode of operation. In the HSLT mode of operation, the shift valve spool 61 is in a position such that each of the fluid passages 65 is in open communication with the source 67, and therefore, is in communication with each of the other passages 65. As the three recirculating volume chambers 33R expand and contract, the fluid merely flows back and forth among the volume chambers 33R, and through the fluid passages 65 and the source 67. What has been described thus far is in commercial usage and therefore is now generally well known.

Referring now primarily to FIG. 2, in conjunction with FIG. 1, one important aspect of the present invention will now be described. In fluid communication with the output of the charge pump 73 is a fluid conduit 81 which is in communication with the fluid inlet of a solenoid operated control valve 83. The control valve 83 is biased by a compression spring 85 toward a "normal" mode or position ("N") in which the control valve 83 connects the fluid conduit 81 to a system reservoir R. The control valve 83 can be shifted from its normal mode "N" shown in FIG. 2 to a shift mode or position ("S") by an electromagnetic solenoid portion 87, in a manner to be described subsequently. When the control valve 83 is in the shift mode "S", pressurized fluid is communicated from the fluid conduit 81 to a fluid passage 89 (also shown in FIG. 1) which is in fluid communication with the motor 10 at a fitting 91 (shown only in FIG. 1).

Figure 5:
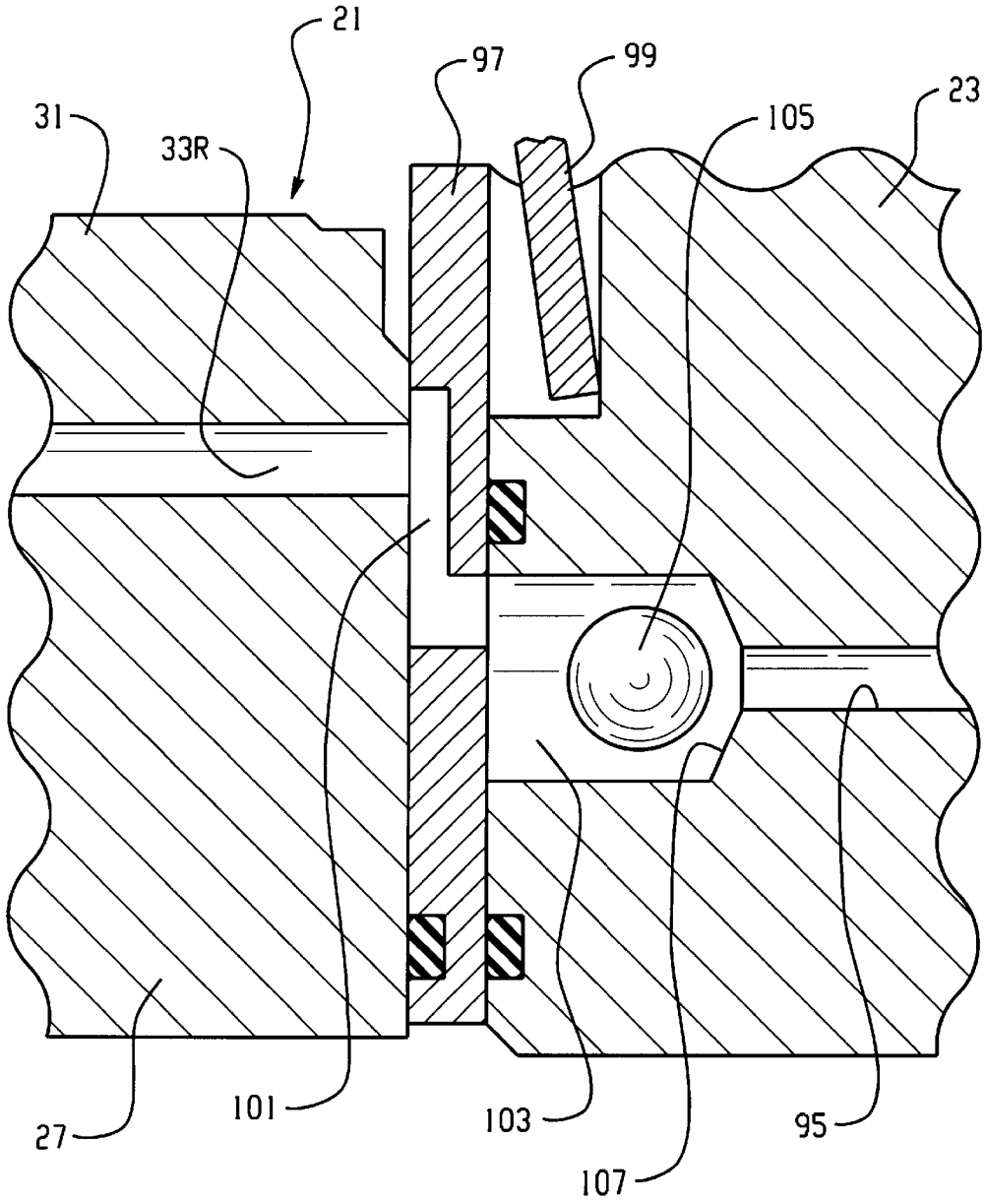
FIG. 5 is a greatly enlarged, fragmentary, axial cross-section, similar to FIG. 1, illustrating in greater detail one important aspect of the present invention.

Referring now to FIGS. 1, 2 and 5, it may be seen that the forward bearing housing 23 defines an annular chamber 93, and in open communication with the chamber 93 is a plurality of axial fluid passages 95, there being one of the fluid passages 95 for each recirculating volume chamber 33R. Therefore, in the subject embodiment, there are three of the axial passages 95 (as is shown schematically in FIG. 2).

Although, in the schematic of FIG. 2, each of the axial fluid passages 95 is shown as being connected to its respective fluid passage 65 (and, if such were literally true, the desired result would be achieved), the actual construction of the preferred embodiment is somewhat different, although fully equivalent, functionally.

As may best be seen in FIGS. 1 and 5, whereas each of the fluid passages 65 communicates with a recirculating volume chamber 33R through one of the stationary valve passages 59, as was described previously, the axial fluid passages 95 are disposed on the opposite axial side of the gerotor gear set 21. It may be seen that, disposed between the gerotor gear set 21 and the forward bearing housing 23, is a balance plate 97 which, in the subject embodiment, and by way of example only, is made in accordance with the teachings of U.S. Pat. No. 6,086,345, assigned to the assignee of the present invention and incorporated herein by reference. Disposed adjacent the balance plate 97 is a Belleville washer 99. It should be understood that the balance plate 97 and the Belleville washer 99 do not form any essential part of the present invention.

However, in accordance with one aspect of the invention, the balance plate 97 (which in and of itself is not essential to the invention) does define a stepped fluid opening 101. A radially inner portion of the opening 101 is in communication with the adjacent recirculating volume chamber 33R, whereas, a radially outer portion of the opening 101 is in open communication with an enlarged axial bore 103. Disposed in the bore 103 is a check valve which, in the subject embodiment, comprises a check ball 105.

The intersection of the axial fluid passage 95 and the enlarged axial bore 103 forms a check valve seat 107, and those skilled in the valve art will understand that whenever the motor 10 is operating in its LSHT mode, and the adjacent volume chamber is either an expanding or contracting volume chamber 33E or 33C, respectively, the check ball 105 is in engagement with the seat 107, and there is no substantial fluid communication between the volume chamber and the passage 95.

However, in accordance with one important aspect of the present invention, when the control valve 83 is in the shift mode "S", pressurized fluid is communicated from the charge pump 73 through the fluid passage 89, to supplement the fluid in the recirculating volume chambers 33R, such that the passage 89 is also referred to hereinafter, and in the appended claims, as a "supplemental" fluid passage. Therefore, the pressurized fluid in the supplemental fluid passage 89 flows through the annular chamber 93 and into each of the axial fluid passages 95, unseating the check ball 105 and providing additional fluid to the adjacent recirculating volume chamber 33R. It is important to note that the supplemental fluid passage 89, and the chamber 93 and passages 95, are all separate from, and in addition to, the "normal" motor valving as defined by the stationary valve plate 19 and the fluid ports 51 and 55.

In accordance with another aspect of the invention, the control valve 83 is in the shift mode "S" only when there is a need for supplemental fluid to be communicated to those volume chambers which had been recirculating volume chambers 33R, until the motor was shifted from HSLT mode to LSHT mode. In order to provide the supplemental fluid only when it is truly needed and beneficial, a position sensor 109 is operably associated with the shift valve spool 61 and provides a signal 111 which may be referred to as a "change sense" signal because it indicates a change in state or sense from the LSHT mode to the HSLT mode (or vice versa). The signal 111 is transmitted to motor control logic, schematically designated 113 in FIG. 2. The control logic 113 receives the change sense signal 111, and when the condition of the signal 111 (e.g., current, duty cycle, etc.) indicates that the shift valve spool 61 is shifting modes (especially if it is shifting from HSLT to LSHT), then the control logic 113 transmits an appropriate command signal 115 to the solenoid portion 87 of the control valve 83, shifting it from its normal mode "N" to its shift mode "S". Therefore, in accordance with one aspect of the invention, the control valve 83 is in the shift mode "S" only while the shift valve spool 61 is changing between the HSLT and LSHT modes of operation.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A fluid pressure operated device comprising housing means defining a fluid inlet port and a fluid outlet port; a fluid pressure displacement mechanism associated with said housing means, and including a stationary member and a rotating member operably associated with said stationary member, said stationary member and said rotating member having relative movement to define a plurality N of expanding and contracting fluid volume chambers in response to said relative movement; motor valve means cooperating with said housing means to provide fluid communication between said fluid inlet port and said expanding volume chambers, and between said contracting volume chambers and said fluid outlet port in a normal low-speed, high-torque mode of operation; shift valve means operable, in a first condition, to permit said normal low-speed, high torque mode of operation and, in a second condition, to interconnect a plurality M of said volume chambers, said plurality M comprising recirculating volume chambers; said fluid pressure operated device being characterized by:

(a) said device defining a supplemental fluid passage operable to provide fluid communication from a source of pressurized fluid to each of said plurality M of recirculating volume chambers; and (b) control valve means operable, in a normal mode, to block fluid communication from said source of pressurized fluid to said supplemental fluid passage, and in a shift mode, to permit fluid communication from said source of pressurized fluid to said supplemental fluid passage.

2. A fluid pressure operated device comprising housing means defining a fluid inlet port and a fluid outlet port; a fluid pressure displacement mechanism associated with said housing means, and including an internally-toothed ring member and an externally-toothed star member eccentrically disposed within said ring member, said ring member and said star member having relative orbital and rotational movement, and interengaging to define a plurality N of expanding and contracting fluid volume chambers in response to said orbital and rotational movement; motor valve means cooperating with said housing means to provide fluid communication between said fluid inlet port and said expanding volume chambers, and between said contracting volume chambers and said fluid outlet port in a normal low-speed, high-torque mode of operation; shift valve means operable, in a first condition, to permit said normal low-speed, high torque mode of operation and, in a second condition, to interconnect a plurality M of said volume chambers, said plurality M comprising recirculating volume chambers; said fluid pressure operated device being characterized by:

(a) said device defining a supplemental fluid passage operable to provide fluid communication from a source of pressurized fluid to each of said plurality M of recirculating volume chambers; and (b) control valve means operable, in a normal mode, to block fluid communication from said source of pressurized fluid to said supplemental fluid passage, and in a shift mode, to permit fluid communication from said source of pressurized fluid to said supplemental fluid passage.

3. A fluid pressure operated device as claimed in claim 2, characterized by check valve means disposed in series flow relationship in said supplemental fluid passage to permit, when said control valve means is in said shift mode, fluid flow from said source of pressurized fluid into said plurality M of recirculating volume chambers, while preventing fluid flow out of said recirculating chambers, through said supplemental fluid passage.

4. A fluid pressure operated device as claimed in claim 3, characterized by said supplemental fluid passage includes a plurality M of passage portions, each of said plurality M of passage portions being in fluid communication with one of said plurality M of recirculating volume chambers.

5. A fluid pressure operated device as claimed in claim 4, characterized by said check valve means comprising a plurality M of individual check valves, each of said individual check valves being disposed in one of said plurality M of passage portions.

6. A fluid pressure operated device as claimed in claim 2, characterized by said device including control logic operable to permit said control valve means to be in said shift mode only while said shift valve means is changing between said first condition and said second condition.

7. A fluid pressure operated device as claimed in claim 6, characterized by said shift valve means includes a sensor, operable to transmit a condition change signal indicative of a change in condition of said shift valve means, said control valve means includes an electrically-actuated valve member, and said control logic is operable to transmit an electrical signal to said control valve means corresponding to said shift mode, only in response to said condition change signal being indicative of a change in condition of said shift valve means.

8. A method of controlling the shifting of a multiple-speed fluid pressure operated device from a first speed ratio to a second speed ratio, said device comprising housing means defining a fluid inlet port and a fluid outlet port; a fluid pressure displacement mechanism associated with said housing means, and including an internally-toothed ring member and an externally-toothed star member eccentrically disposed within said ring member, said ring member and said star member having relative orbital and rotational movement, and interengaging to define a plurality N of expanding and contracting fluid volume chambers in response to said orbital and rotational movement; motor valve means cooperating with said housing means to provide fluid communication between said fluid inlet port and said expanding volume chambers, and between said contracting volume chambers and said fluid outlet port in said first speed ratio; shift valve means operable, in a first condition to achieve said first speed ratio, and in a second condition to achieve said second speed ratio by interconnecting a plurality M of said volume chambers as recirculating volume chambers; said method of controlling the shifting comprising the steps of:

(a) providing a source of pressurized fluid, and a supplemental fluid passage operable to provide fluid communication from said source to each of said plurality M of recirculating volume chambers;

(b) changing said shift valve means from one of said first and second conditions to the other of said first and second conditions;

(c) sensing said changing of said shift valve means and, only while said changing is being sensed, generating a change sense signal; and (d) detecting said change sense signal and in response thereto, permitting fluid communication from said source of pressurized fluid, through said supplemental fluid passage, to said plurality M of recirculating volume chambers.

9. The method of controlling the shifting of a multiple-speed fluid pressure operated device, as claimed in claim 8, characterized by said step of changing said shift valve means comprises the step of changing said shift valve means from said second condition to said first condition.

* * * * *